US008021195B2

(12) United States Patent
He et al.

(10) Patent No.: US 8,021,195 B2
(45) Date of Patent: Sep. 20, 2011

(54) ELECTRICAL CONNECTOR WITH IMPROVED CONTACT ARRANGEMENT

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/578,525

(22) Filed: Oct. 13, 2009

(65) Prior Publication Data

US 2010/0093222 A1 Apr. 15, 2010

(30) Foreign Application Priority Data

Oct. 14, 2008 (CN) ..... 2009 2 0186171

(51) Int. Cl.
*H01R 27/00* (2006.01)

(52) U.S. Cl. ..... 439/638

(58) Field of Classification Search ..... 439/638, 439/660, 218, 79, 607.04, 607.27, 541.5, 439/540.1

See application file for complete search history.

(56) References Cited

U.S. PATENT DOCUMENTS

| | | | | |
|---|---|---|---|---|
| 5,779,489 | A | 7/1998 | Davis et al. | |
| 6,210,224 | B1 * | 4/2001 | Wu | 439/607.4 |
| 7,318,752 | B2 * | 1/2008 | Fujimoto et al. | 439/660 |
| 7,517,253 | B1 * | 4/2009 | Chiang | 439/660 |

* cited by examiner

*Primary Examiner* — Alexander Gilman

(74) *Attorney, Agent, or Firm* — Andrew C. Cheng; Wei Te Chung; Ming Chieh Chang

(57) ABSTRACT

An electrical connector (100) includes an insulative housing (10) which includes a first housing (11) and a second housing (12) engaging with each other, a number of first contacts (2) insert molded in the first housing (11), and a number of second contacts (3) retained in the second housing (12). The first housing (11) has a body portion (13) and a tongue (14) extending from the body portion (13). Each first contact (2) has a first contact portion (22) extending to the tongue (14) and a first soldering portion (23) extending out of the first housing (11). Each second contact (3) has a second securing portion (31) retained on the second housing (12), a second contact portion (32) extending to the tongue (14) behind the first contact portions (22), and a second soldering portion (33) extending out of the second housing (12).

20 Claims, 7 Drawing Sheets

ELECTRICAL CONNECTOR WITH IMPROVED CONTACT ARRANGEMENT

BACKGROUND OF THE INVENTION

1. Field of the Invention

The present invention relates to an electrical connector, and more particularly to electrical connectors with improved contact arrangement.

2. Description of Related Art

Universal Serial Bus (USB) is used widely in various electronic devices as a standard and simple interface. Up to now, previous notable releases of the USB specification were 0.9, 1.0, 1.1 and 2.0. Equipment conforming to any version of the standard will also work with devices designed to any previous specification (known as: backward compatibility).

USB mentioned above supports three data rates respectively as follows: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s).

However, as the development of electric industry, even the USB 2.0 can not satisfy the requirement of many electric devices. For example, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

However, these non-USB protocols, such as PCI Express which is useful for its higher possible data rates, a 26-pin connectors and wider card-like form factor limit the use of Express Cards, and SATA which uses two connectors, one 7-pin connector for signals and another 15-pin connector for power, are not used as broadly as USB protocols. Many portable devices are equipped with USB connectors other than these non-USB connectors. One important reason is that these non-USB connectors contain a greater number of signal pins than an existing USB connector and are physically larger as well, and the greater number of signal pins is assembled difficultly, especially in an electrical connector. Due to its clumsiness, the PCI Express and SATA connector can not adapt to the development trend of gently, thin, short and small size.

USB connector is soldered on a circuit board of a computer usually. The USB 2.0 A type connector according to USB-IF usually comprises an insulative housing with a tongue plate extending forwardly, four contacts retained in the insulative housing and a metal shield. Each contact has a contact portion extending to a lower side of the tongue plate and exposing out thereof flexibly. The contact portion presents as arc type and can move along a thickness direction of the tongue. The four contacts comprise a power contact, a grounding contact, a – data contact and a + data contact. The – data contact and + data contact present as a pair of differential signal contacts which are located between the power contact and the grounding contact. The metal shield encloses the tongue plate and forms a first receiving space for receiving a USB plug.

Hence, an electrical connector which is based USB interface, but has a high signal transmission speed and an improved contacts arrangement, is desired to overcome the disadvantage of the prior art.

BRIEF SUMMARY OF THE INVENTION

According to the present invention, an electrical connector defines a mating face and an insert opening extending inwardly from the mating face; the electrical connector comprises an insulative housing which has a first housing and a second housing combined to each other along an up to down direction, the first housing defining a body portion and a tongue extending into the insert opening; and a plurality of first contacts insert molded in the first housing, each first contact having a first contact portion extending to the tongue and exposed toward the insert opening and a first soldering portion extending out of the first housing; and a plurality of second contacts retained on the second housing, each second contact having a second contact portion extending to the tongue and exposed toward the insert opening, a second soldering portion extending out of the second housing and a second securing portion retained on the second housing.

According to another aspect of the present invention, an electrical connector comprises: a first housing being insert molded around a plurality of first contacts, the first housing being formed with a body portion and a tongue extending forwardly from the body portion, each first contact having a first contact portion extending to a front end of the tongue; a second housing attached to the body portion along an up to down direction, the second housing defining a plurality of level slots extending therethrough along a front to back direction, and a plurality of vertical slots corresponding to the level slots and extending along the up to down direction; and a plurality of second contacts each having a second securing portion retained on the second housing, a second contact portion extending to the tongue behind the first contact portions and a second soldering portion extending out of the second housing, each second securing portion having a level portion retained in the level slot and a vertical portion retained in the vertical slot.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
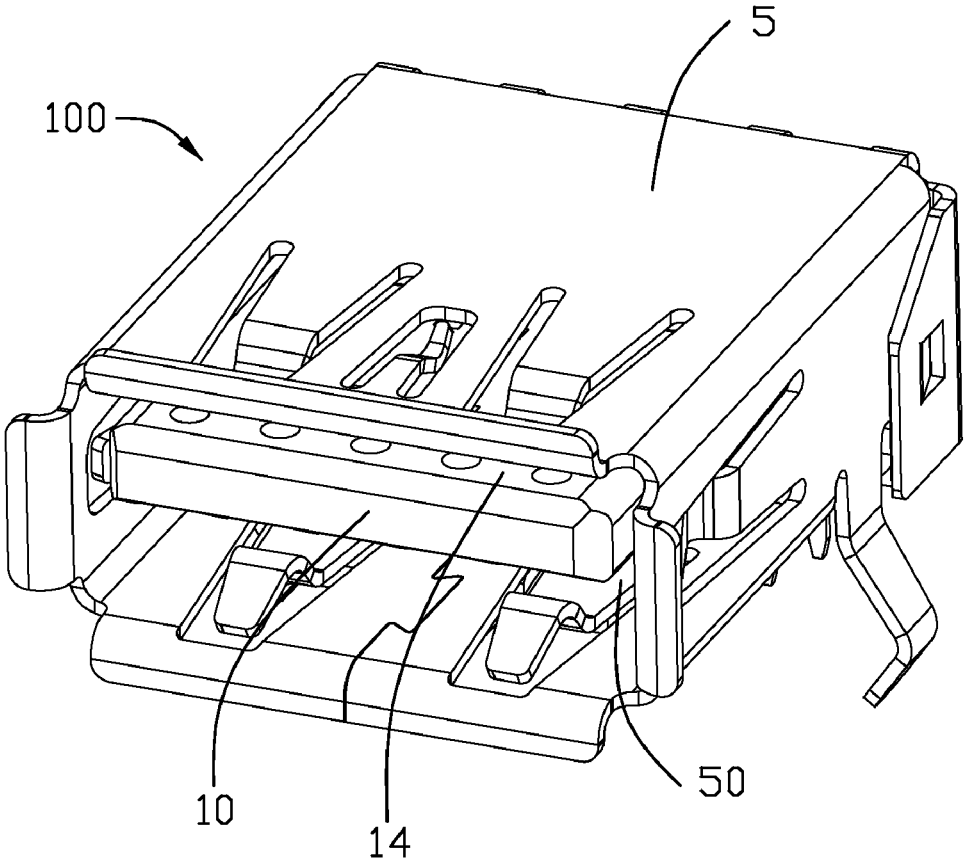
FIG. 1 is a perspective view of an electrical connector according to the present invention.
Figure 2:
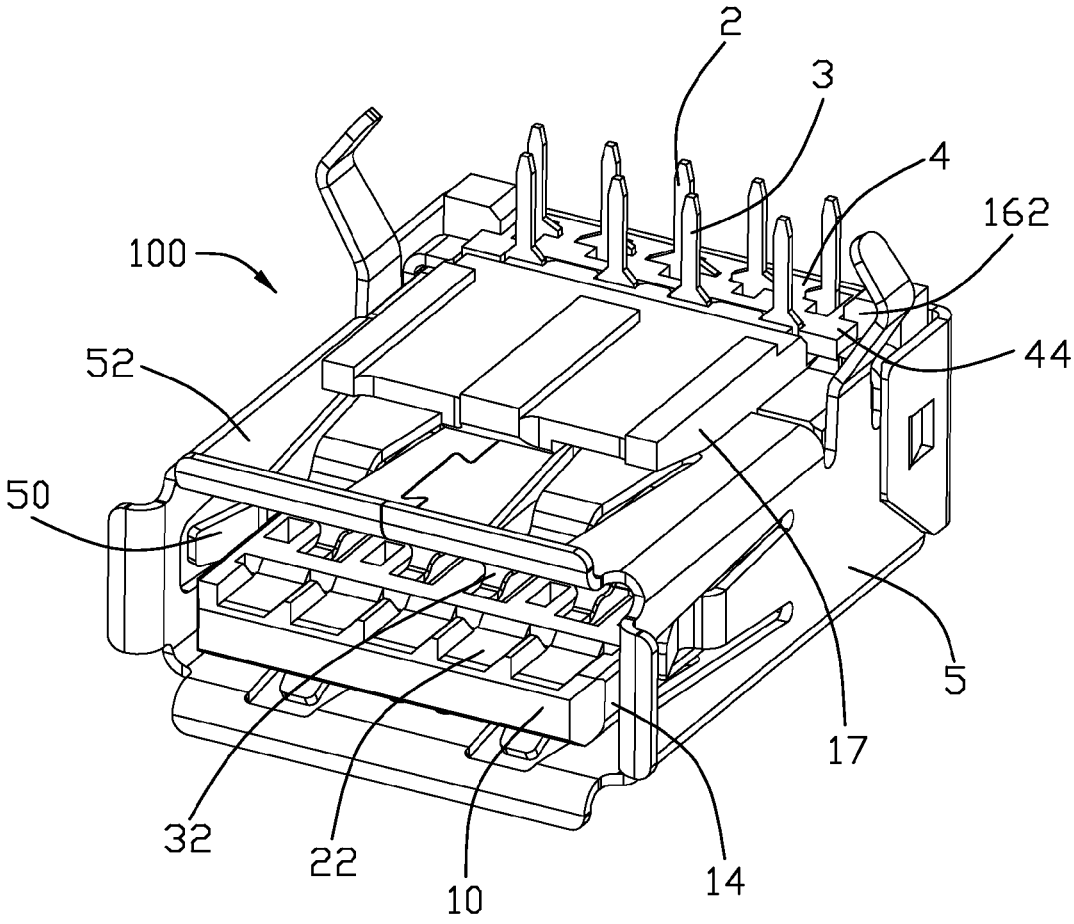
FIG. 2 is a view similar to FIG. 1, while taken from another aspect.
Figure 3:
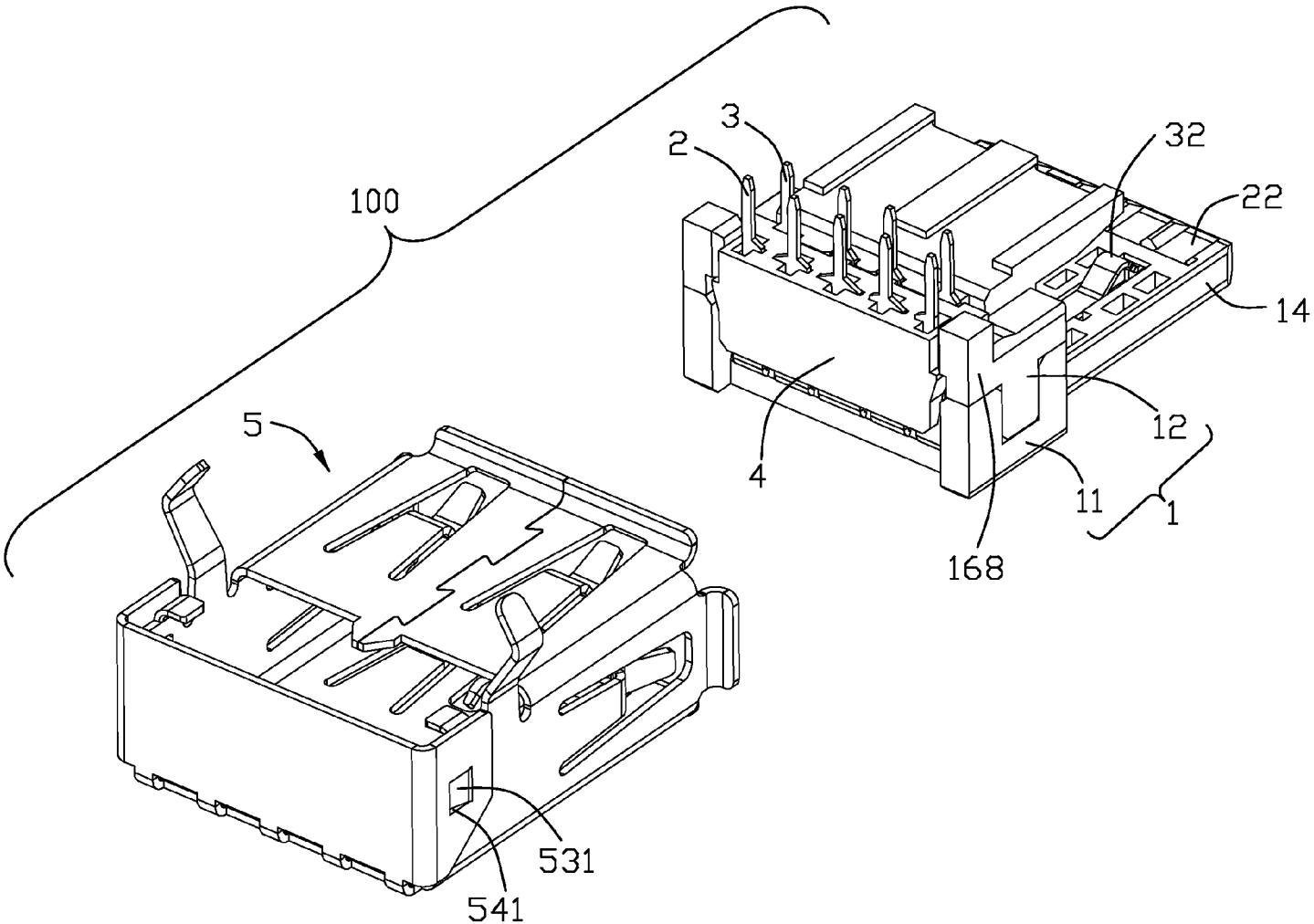
FIG. 3 is a perspective view of the electrical connector with a metal shell divided therefrom.
Figure 4:
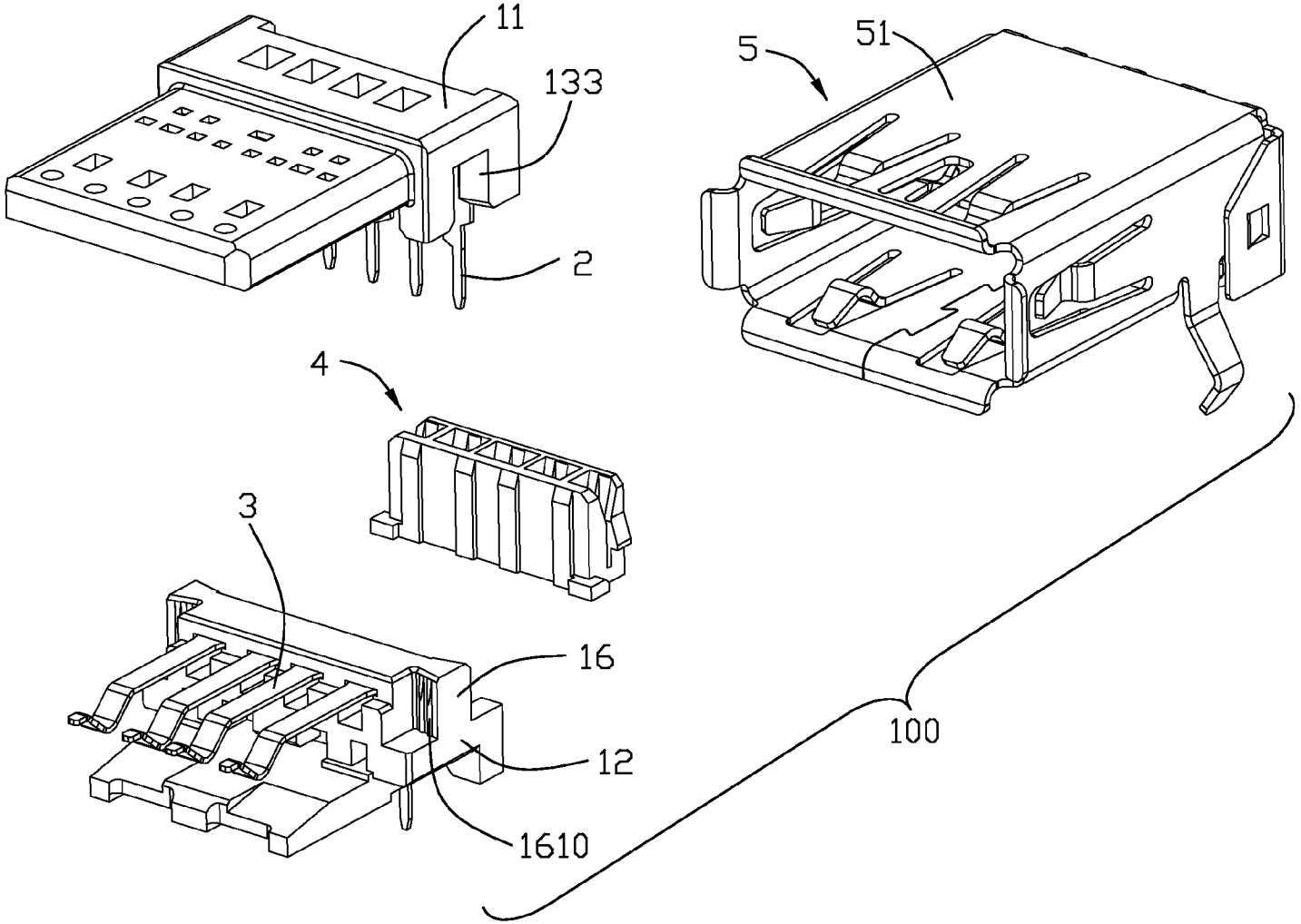
FIG. 4 is a partial exploded view of the electrical connector shown in FIG. 1.
Figure 5:
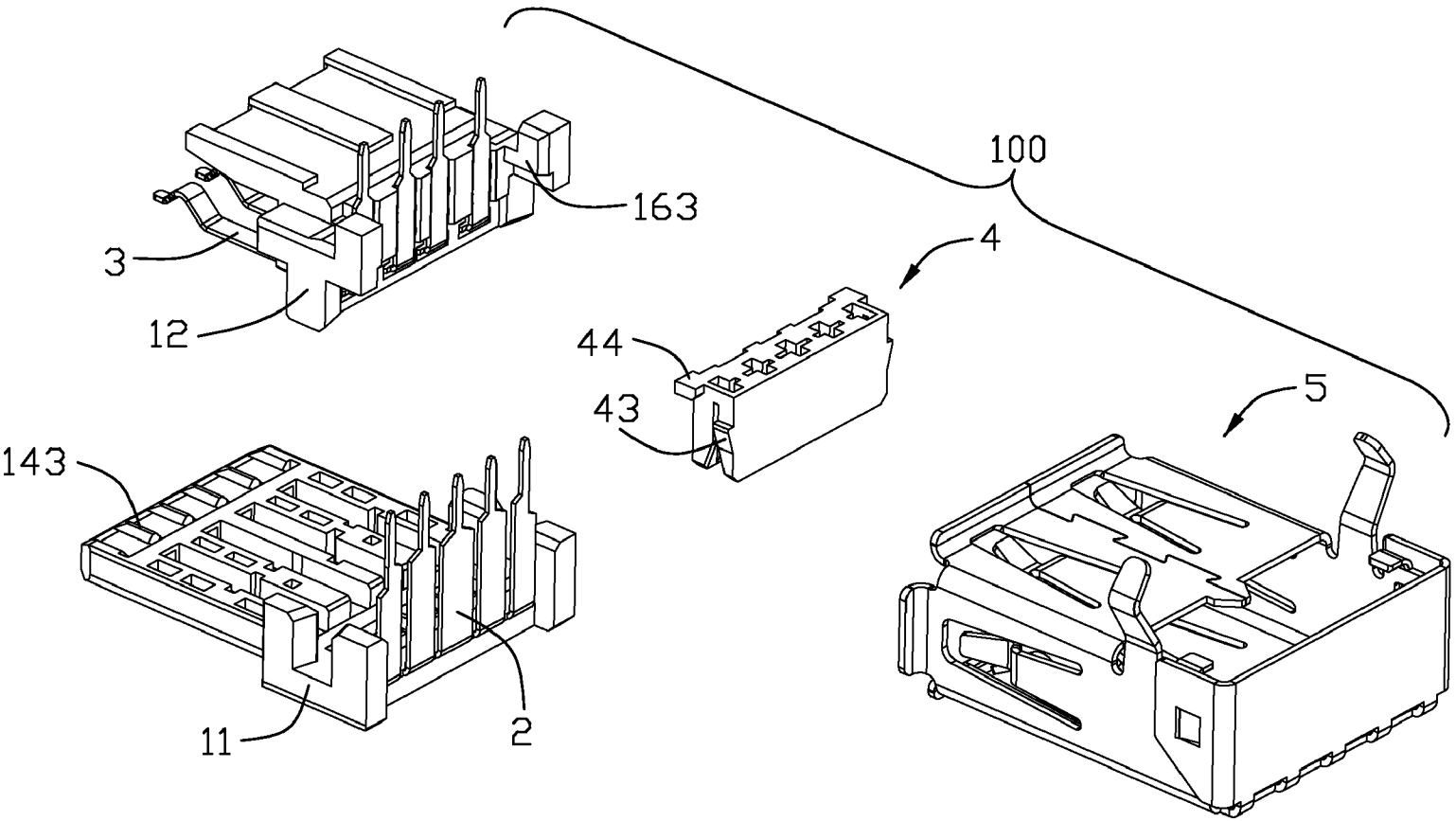
FIG. 5 is a view similar to FIG. 4, while taken from another aspect.
Figure 6:
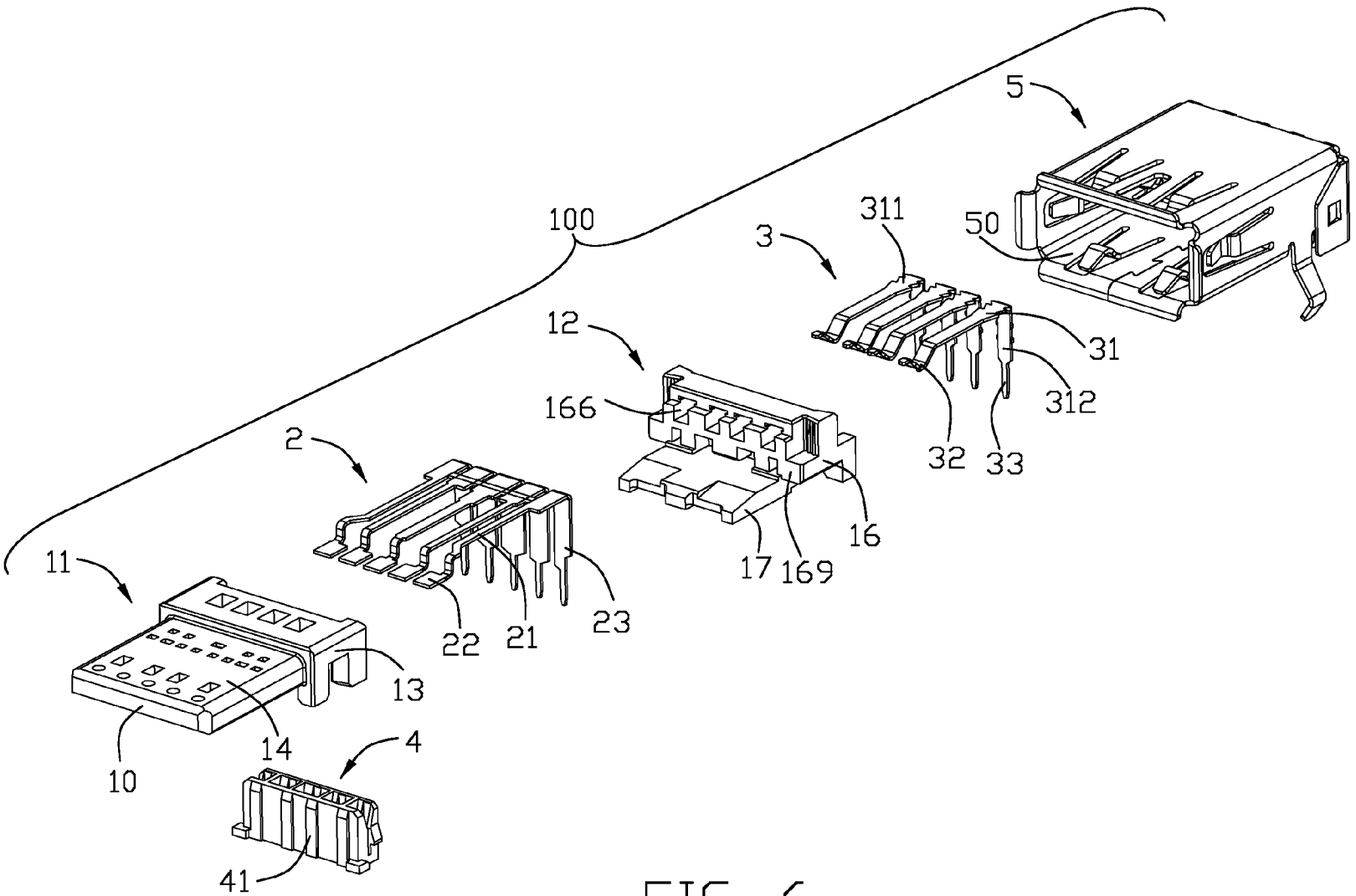
FIG. 6 is an exploded view of the electrical connector shown in FIG. 1.
Figure 7:
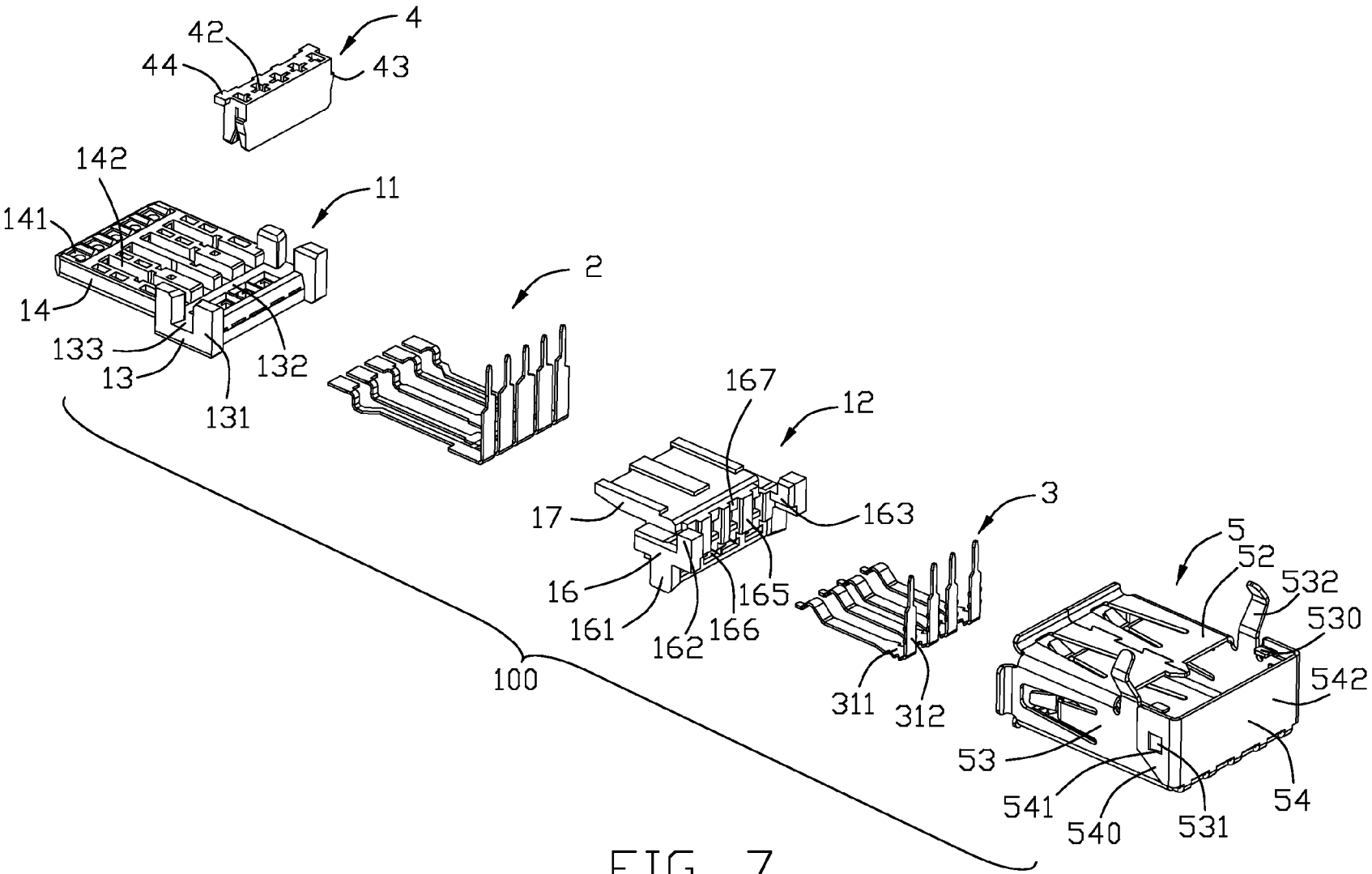
FIG. 7 is a view similar to FIG. 6, while taken from another aspect.

Referring to FIGS. 1-7, an electrical connector 100 according to the present invention is disclosed. The electrical connector 100 defines a mating face 10 and an insert opening 50 extending inwardly from the mating face 10. The electrical connector 100 comprises an insulative housing 1, a plurality of first contacts 2 and second contacts 3 retained on the insulative housing 1, a spacer 4 retained on a rear side of the insulative housing 1 and a metal shell 5 enclosing the insulative housing 1. The first contacts 2 transmit high speed signals, and the second contacts 3 are USB 2.0 contacts for transmitting USB 2.0 signals. The electrical connector 100 can electrically connect with a standard USB 2.0 A type plug (not shown).

The insulative housing 1 comprises a first housing 11 and a second housing 12 combined to each other along an up to down direction. The first housing 11 has a body portion 13 and a tongue 14 extending forwardly into the insert opening 50 from the body portion 13. The body portion 13 has a pair of side walls 131 and a cavity 132 between the side walls 131 for receiving the second housing 12. The side walls 131 define two swallow-tailed recesses 133 at two sides of the cavity 132 and communicating with the cavity 132 along a width direction of the first housing 11. A front face of the tongue 14 is said mating face 10 of the electrical connector 100. The tongue 14 is formed with a plurality of first depressions 141 extending to a front end of the tongue 14, and a plurality of second depressions 142 behind the first depressions 141.

The second housing 12 comprises a base portion 16 and an accessorial board 17 extending forwardly from a bottom side of the base portion 16. The base portion 16 is partly received in the cavity 132, and has two swallow-tailed projections 161 at two sides thereof to engage with the swallow-tailed recesses 132 for fastening the first housing 11 and the second housing 12 together. The swallow-tailed projection 161 has a plurality of protrusions 1610 engaging with inner side walls of the swallow-tailed recesses 132 for fastening the second housing 12 to the first housing 11 stably. The base portion 16 has a pair of extension portions 162 extending backwardly and downwardly from two sides of the base portion 16, and a receiving space 165 between the extension portions 162 for receiving the spacer 4. The extension portions 162 each has a locking projection 163 extending into the receiving space 165. The base portion 16 defines a plurality of level slots 166 extending therethrough along a front to back direction and a plurality vertical slots 167 corresponding to the level slots 166. The level slots 166 are located at a rear side of the second depressions 142 and communicate with the depressions 142 along the front to back direction. The vertical slots 167 open to exterior and extend through the base portion 16 along the up to down direction. The base portion 16 has a pair of side surfaces 168 which are located at same planes with corresponding side walls 131 of the body portion 13 respectively, and a front surface 169 which is located at a same plane with that of the body portion 13.

The first contacts 2 are insert molded in the first housing 11 and comprise two pairs of differential signal contacts and a ground contact between the two pairs of differential signal contacts. A pair of differential signal contacts in said two pairs transmit high speed signals, and another pair of differential signal contacts in said two pairs receive high speed signals. The ground contact decreases crosstalk between two pairs of differential signal contacts. Each first contact 2 has a first securing portion 21 insert molded in the first housing 11, a first flat contact portion 22 extending forwardly from the first securing portion 21, and a soldering portion 23 extending perpendicularly downwardly from the first securing portion 21. The first contact portions 22 extend to the first depressions 141 of the tongue 14 and flatly affixed to the tongue 14. The tongue 14 is formed with a plurality of ribs 143 between adjacent first depressions 141 to separate the first contact portions 22 from each other. The first soldering portions 23 extend out of the first housing 11 for soldering to a circuit board (not shown).

The electrical connector 100 in the present invention comprises four said second contacts 3 which are adapted for USB 2.0 protocol and transmit USB 2.0 signals. The second contacts 3 comprise a power contact, a ground contact and a pair of differential signal contacts. Each second contact 3 has a second securing portion 31 retained in the second housing 12, an elastic second contact portion 32 extending forwardly from the second securing portion 31, and a second soldering portion 33 extending perpendicularly downwardly from the second securing portion 31. An arrangement of the second contact portions 32 on the tongue 14 is compatible to a standard USB 2.0 A type plug (not shown). The first contact portions 22 and the second contact portions 32 are exposed toward the insert opening 50 for connecting with corresponding plug (not shown). The second securing portion 31 has a level portion 311 retained in the level slot 166 and a vertical portion 312 retained in the vertical slot 167.

The elastic second contact portions 32 extend to the tongue 14 and cantleveredly received in the second depressions 142 behind the first contact portions 22. Therefore, the first contact portions 22 and the second contact portions 32 are arranged at a same side of the tongue 14 along a thickness direction of the tongue 14 and arranged in two rows along the front to back direction, the tongue 14 needs not be notched at two sides thereof for increasing the intensity thereof Besides, the first contact portions 22 are flatly affixed to first depressions 141, and the second contact portions 32 are cantleveredly received in the second depressions 142 and extend out of the tongue 14, thereby, the first contact portions 22 and the second contact portions 32 are located at different planes along the thickness direction for electrically connecting with corresponding plug reliably. In addition, the accessorial board 17 is spaced apart from the second contact portions 32 and the tongue 14 along the up to down direction.

The spacer 4 presents as a rectangular insulator and is retained on a rear side of the first housing 11 and the second housing 12. The spacer 4 defines a plurality of through holes 42 extending therethrough along the up to down direction for positioning the first soldering portions 23, and a plurality of blocks 41 extending along an up to down direction at a front side thereof for pressing the vertical portions 312 of the second contacts 3. The spacer 4 has two hooks 43 extending outwardly at two sides thereof to engage with the locking projections 163 for preventing the spacer 4 from moving downwardly, and a pair of limiting projections 44 extending forwardly from a bottom side of the spacer 4 to abut against a bottom side of the first housing 11 for preventing the spacer 4 from moving upwardly.

The metal shell 5 comprises a pair of opposed top wall 51 and bottom wall 52, a pair of opposed side walls 53 connecting the top wall 51 and bottom wall 52, and a rear cover 54 bending downwardly from a rear end of the top wall 51. The top wall 51, bottom wall 52 and side walls 53 surround the tongue 14 to form the insert opening 50. Each side wall 53 has a latch 530 bending inwardly from a bottom end thereof for buttoning the bottom of the spacer 4, and a mounting leg 532 extending downwardly for positioning to the circuit board. The rear cover 54 has a flat portion 542 and a pair of flanges 540 extending forwardly from two sides of the flat portion 542. The flanges 540 are located at an outer side of the side walls 53 and each defines an opening 541. The side walls 53 each has a locking tang 531 extending outwardly to lock with the opening 541. The accessorial board 17 is located at a lower side of the bottom wall 52 for preventing the metal shell 5 from distorting. The latches 530 and the flat portion 542 sandwich extension portions 162 therebetween for fastening the second housing 12 stably.

As fully described above, the second contacts 3 are adapted for USB protocol and transmit USB 2.0 signals, and an arrangement of the second contact portions 32 on the tongue 14 is compatible to a standard USB 2.0 A type plug, thereby, the electrical connector 100 is based on the standard USB 2.0 A type receptacle and can mate with the standard USB 2.0 A type plug. In addition, the electrical connector 100 adds the first contacts 2 to the standard USB 2.0 A type receptacle, thereby the differential signal contacts in the first contacts 2 increase transmission speed of the electrical connector 100 in the present invention. Besides, the first contacts 2 are insert molded in the first housing 11, the second contacts 3 are assembled to the second housing 12 and installed to the first housing 11 with the second housing 12 then, the assemble process and cost can be decreased, and the contacts can not puncture the insulative housing 1.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector defining a mating face and an insert opening extending inwardly from the mating face, comprising:

an insulative housing comprising a first housing and a second housing assembled to each other along an up to down direction perpendicular to an insertion direction of a corresponding plug, the first housing defining a body portion and a tongue extending into the insert opening; and a plurality of first contacts insert molded in the first housing, each first contact having a first contact portion extending to the tongue and exposed toward the insert opening and a first soldering portion extending out of the first housing; and a plurality of second contacts retained on the second housing, each second contact having a second contact portion partly assembled to a plurality of depressions of the tongue along the up to down direction and exposed toward the insert opening, a second soldering portion extending out of the second housing and a second securing portion retained on the second housing.

2. The electrical connector according to claim 1, wherein the first contact portion extends to a front end of the tongue, and the second contact portions are located behind the first contact portions, and both the first contact portion and the second contact portion expose a bottom surface thereof in the insert opening.

3. The electrical connector according to claim 1, wherein the first contact portions are flatly affixed to the tongue, and the second contact portions are elastic, the first contact portions and the second contact portions are arranged in two rows along a front to back direction of the tongue and expose to a same side of the tongue along the up to down direction.

4. The electrical connector according to claim 2, wherein the body portion defines a cavity with a pair of swallow-tailed recesses at two sides thereof, the second housing has a base portion partly retained in the cavity, and the base portion has a pair of swallow-tailed projections at two sides thereof to engage with the swallow-tailed recesses for fastening the first housing and the second housing together.

5. The electrical connector according to claim 4, wherein the swallow-tailed projection has a plurality of protrusions engaging with inner side walls of the swallow-tailed recesses for fastening the second housing to the first housing stably.

6. The electrical connector according to claim 4, wherein the base portion defines a plurality of level slots extending therethrough along the front to back direction and a plurality vertical slots corresponding to the level slots, and each second securing portion has a level portion retained in the level slot and a vertical portion retained in the vertical slot.

7. The electrical connector according to claim 4, wherein the second housing has an accessorial board extending forwardly from a bottom side of the base portion, the accessorial board is spaced apart from the second contact portions and the tongue along the up to down direction.

8. The electrical connector according to claim 7, further comprising a metal shell enclosing the insulative housing, the metal shell comprises a pair of opposed top wall and bottom wall, and a pair of opposed side walls connecting the top wall and the bottom wall, the accessorial board is located at a lower side of the bottom wall for preventing the metal shell from distorting.

9. The electrical connector according to claim 4, wherein the base portion has a pair of side surfaces which are located at same planes with corresponding side walls of the body portion respectively, and a front surface which is located at a same plane with that of the body portion.

10. The electrical connector according to claim 1, further comprising a spacer retained on a rear side of the first housing, the spacer defines a plurality of through holes for positioning the first contacts, and a plurality of blocks extending along an up to down direction at a front side thereof for pressing the vertical portions of the second contacts.

11. The electrical connector according to claim 2, wherein the tongue is formed with a plurality of ribs between adjacent first contact portions to separate the first contact portions from each other.

12. The electrical connector according to claim 1, wherein the contacts comprises four side second contacts, and the second contacts are adapted to USB 2.0 protocol and comprise a power contact, a ground contact and a pair of differential signal contacts, the first contacts comprise two pairs of differential signal contacts and a ground contact between the two pairs of differential signal contacts.

13. An electrical connector comprising:

a first housing being insert molded around a plurality of first contacts, the first housing being formed with a body portion and a tongue extending forwardly from the body portion, each first contact having a first contact portion extending to a front end of the tongue;

a second housing attached to the body portion along an up to down direction, the second housing defining a plurality of level slots extending therethrough along a front to back direction, and a plurality of vertical slots corresponding to the level slots and extending along the up to down direction; and a plurality of second contacts each having a second securing portion retained on the second housing, a second contact portion extending to the tongue behind the first contact portions and a second soldering portion extending out of the second housing, each second securing portion having a level portion assembled and retained in the level slot and a vertical portion assembled and retained in the vertical slot.

14. The electrical connector according to claim 13, wherein the tongue defines a plurality of depressions behind the first contact portions, the level slots are located at a rear side of the depressions and communicate with the depressions, and both the depression and the first contact portion are disposed on a same surface of the first housing.

15. The electrical connector according to claim 14, wherein the second contact portions extend directly forwardly from the level portions, and the second soldering portions extend directly downwardly from the vertical portions.

16. The electrical connector according to claim 15, wherein the second contact portions extend to the depressions and cantileveredly received in the depressions.

17. The electrical connector according to claim 13, wherein the second housing has a base portion and an accessorial board extending forwardly from a bottom side of the base portion, the accessorial board is spaced apart from the second contact portions and the tongue along the up to down direction.

18. An electrical connector comprising:

a first insulative housing having thereof a plate portion defining a plurality of recesses;

a plurality of first contacts insert molded within the first housing, each of said first contacts including a flat contacting section at a front end of the first housing;

a second insulative housing configured to be only vertically assembled to the first housing;

a plurality of second contacts retained to the second housing, each of said second contacts including a resilient contacting section partially received within the corresponding recess and cooperating with the flat contacting section of the corresponding first contact to face a same vertical direction for mating with a complementary connector under condition that the flat contacting sections are located in front of the resilient contact sections in a front-to-back direction perpendicular to said vertical direction; wherein a metallic shell encloses said plate portion of the first housing.

19. The electrical connector as claimed in claim 18, wherein said second housing further unitarily includes an accessorial board outside of said shell in said vertical direction.

20. The electrical connector according to claim 18, wherein the second insulative housing defines a plurality of level slots extending therethrough along the front to back direction and a plurality vertical slots corresponding to the level slots, and each second contacts has a second securing portion which has a level portion assembled and retained in the level slot and a vertical portion assembled and retained in the vertical slot.

* * * * *